US009472081B1

(12) United States Patent
Pridgen

(10) Patent No.: US 9,472,081 B1
(45) Date of Patent: Oct. 18, 2016

(54) CHILD LOCATOR SYSTEM

(71) Applicant: Edward Pridgen, Havelock, NC (US)

(72) Inventor: Edward Pridgen, Havelock, NC (US)

( * ) Notice: Subject to any disclaimer, the term of this patent is extended or adjusted under 35 U.S.C. 154(b) by 0 days.

(21) Appl. No.: 14/704,308

(22) Filed: May 5, 2015

(51) Int. Cl.
*G08B 21/02* (2006.01)

(52) U.S. Cl.
CPC ..... *G08B 21/0202* (2013.01)

(58) Field of Classification Search
CPC ..... G08B 21/0202
See application file for complete search history.

(56) References Cited

U.S. PATENT DOCUMENTS

| | | | | |
|---|---|---|---|---|
| 5,423,574 | A | 6/1995 | Forte-Pathroff | |
| 6,169,494 | B1 | 1/2001 | Lopes | |
| 6,321,091 | B1 | 11/2001 | Holland | |
| 6,362,778 | B2 | 3/2002 | Neher | |
| 6,828,908 | B2 | 12/2004 | Clark | |
| 7,233,240 | B2 | 6/2007 | Phillips | |
| 8,102,316 | B1 | 1/2012 | Brucker | |
| 2004/0046658 | A1* | 3/2004 | Turner | G08B 21/0227 340/539.11 |
| 2004/0087314 | A1* | 5/2004 | Duncan | G01C 21/00 455/456.1 |
| 2004/0198382 | A1 | 10/2004 | Wong | |
| 2008/0062120 | A1* | 3/2008 | Wheeler | G08B 25/016 345/156 |
| 2015/0109126 | A1* | 4/2015 | Crawford | G08B 21/0269 340/539.13 |

FOREIGN PATENT DOCUMENTS

| | | |
|---|---|---|
| CN | 202453506 U | 9/2012 |

* cited by examiner

*Primary Examiner* — Leon Flores

(57) ABSTRACT

The child locator system comprises a display unit and a tracking unit. The tracking unit is a GPS locator that is attached to the child's clothing using a magnetic lock similar to those used to protect clothing in retail stores. The display unit is also fitted with a GPS locator. The tracking unit wirelessly communicates its position to the display unit. The display unit monitors the position of the tracking unit relative to the position of the display unit. Should the display unit lose contact with the tracking unit or should the tracking unit move more than a predetermined distance away from the display unit an alarm is sounded. The display unit is integrated with mapping software that can display the current (or last known) positions of both the display unit and the tracking unit on demand.

4 Claims, 3 Drawing Sheets

CHILD LOCATOR SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of computer-controlled navigation and the global positioning system, more specifically, a tracking device configured for use with a tablet or smart phone.

SUMMARY OF INVENTION

The child locator system comprises a display unit and a tracking unit. The tracking unit is a GPS locator that is attached to the child's clothing using a magnetic lock similar to those used to protect clothing in retail stores. The display unit is also fitted with a GPS locator. The tracking unit wirelessly communicates its position to the display unit. The display unit monitors the position of the tracking unit relative to the position of the display unit. Should the display unit lose contact with the tracking unit or should the tracking unit move more than a predetermined distance away from the display unit an alarm is sounded. The display unit is integrated with mapping software that can display the current (or last known) positions of both the display unit and the tracking unit on demand.

These together with additional objects, features and advantages of the child locator system will be readily apparent to those of ordinary skill in the art upon reading the following detailed description of the presently preferred, but nonetheless illustrative, embodiments when taken in conjunction with the accompanying drawings.

In this respect, before explaining the current embodiments of the child locator system in detail, it is to be understood that the child locator system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the child locator system.

It is therefore important that the claims be regarded as including such equivalent construction insofar as they do not depart from the spirit and scope of the child locator system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
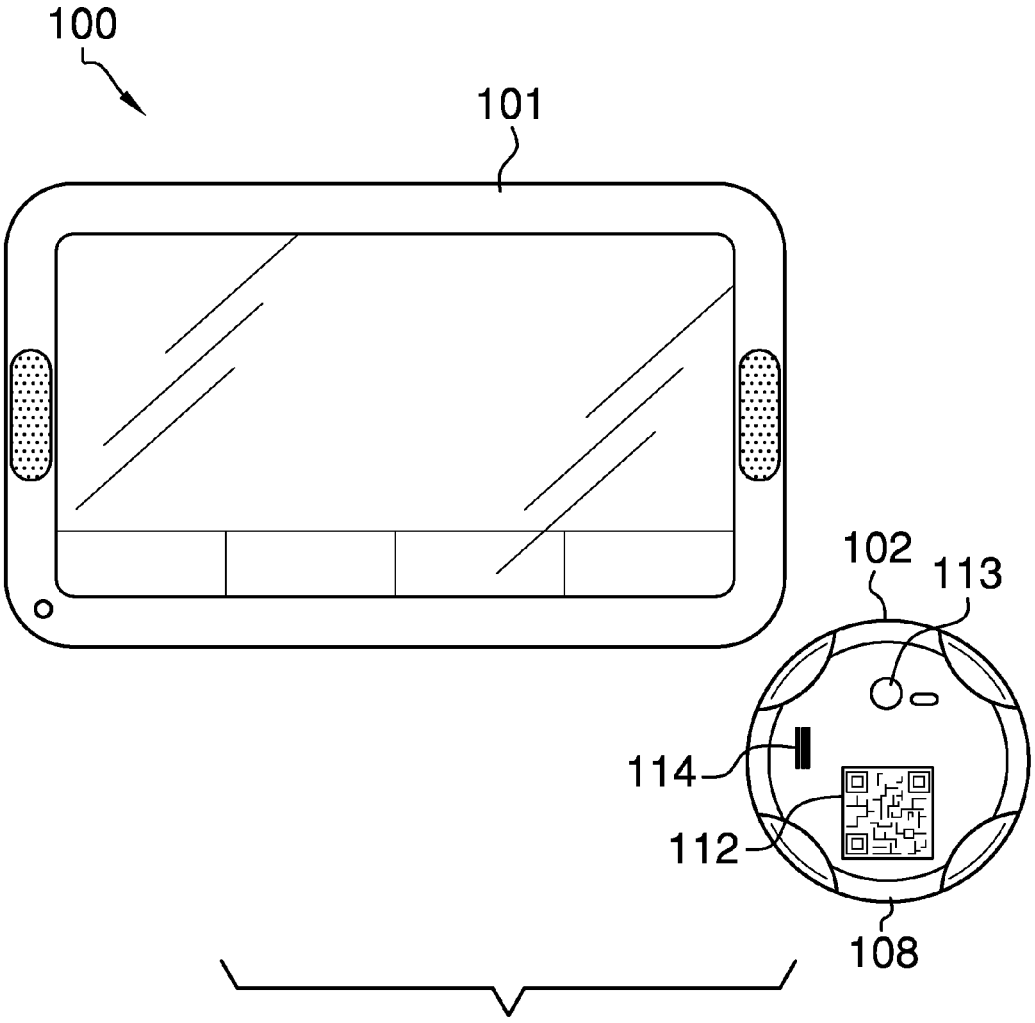
FIG. 1 is a front view of an embodiment of the disclosure.
Figure 2:
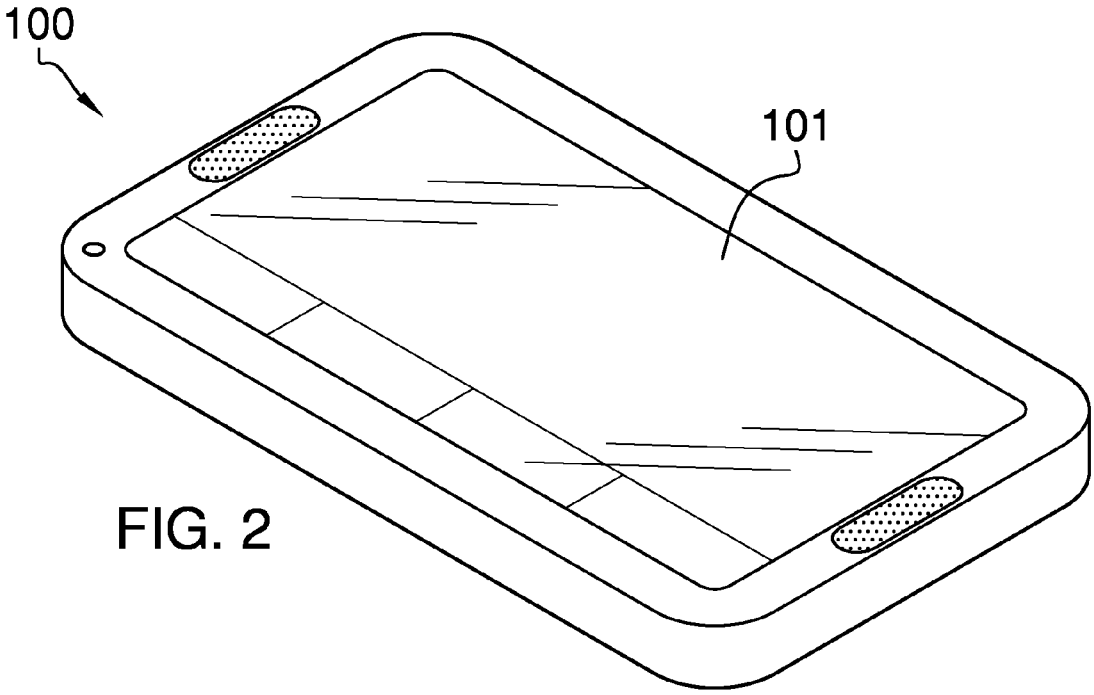
FIG. 2 is a perspective view of an embodiment of the disclosure.
Figure 3:
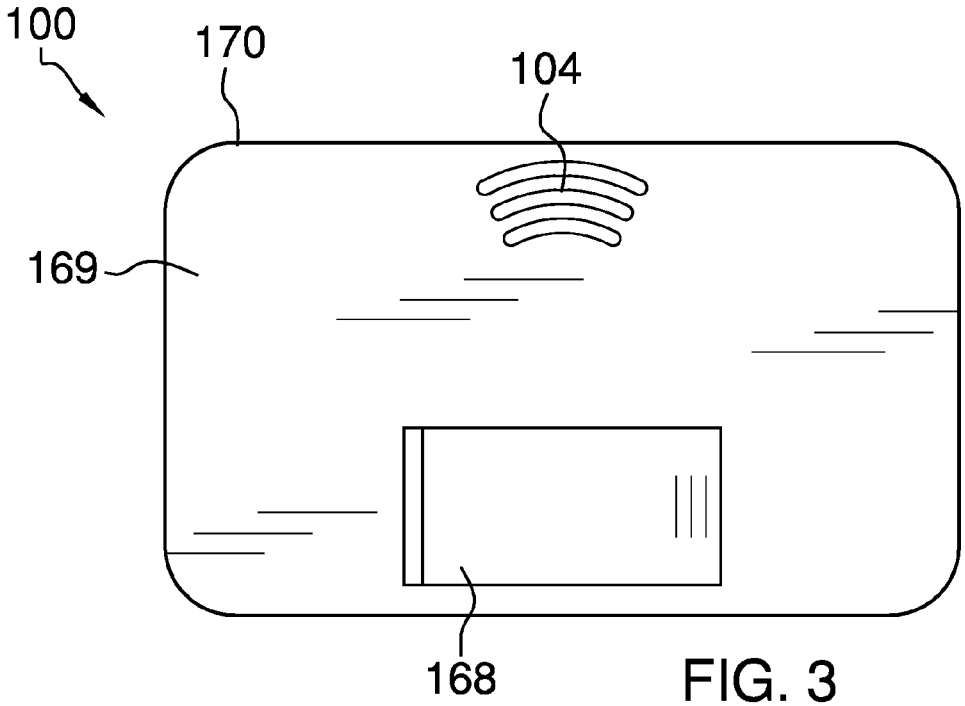
FIG. 3 is a back view of an embodiment of the disclosure.
Figure 4:
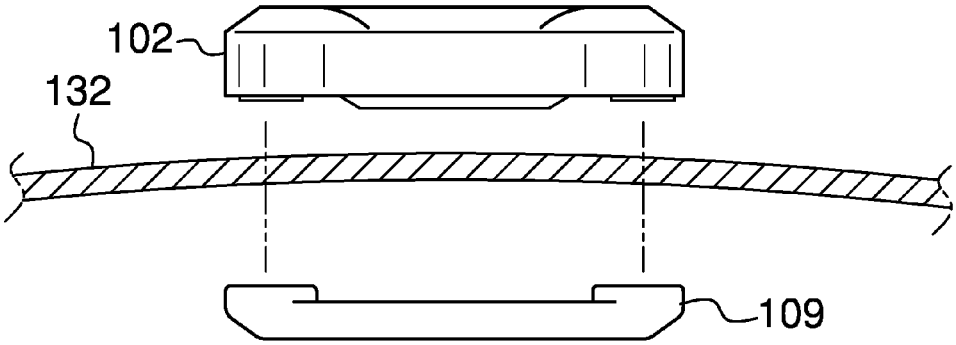
FIG. 4 is a top view of an embodiment of the disclosure.
Figure 5:
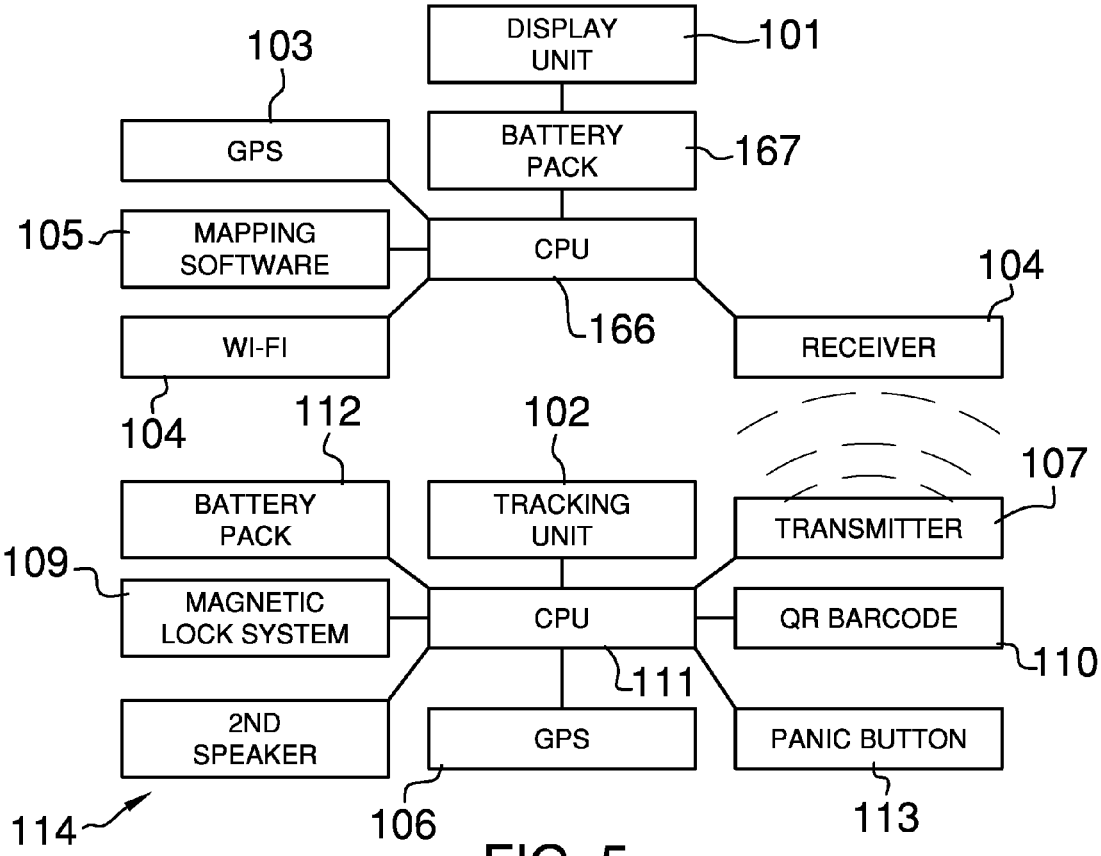
FIG. 5 is a block view of an embodiment of the disclosure.

Detailed reference will now be made to a first potential embodiment of the disclosure, which is illustrated in FIGS. 1 through 5. The child locator system 100 (hereinafter invention) comprises a display unit 101 and a tracking unit 102.

The display unit 101 is a commercially available tablet or smart phone that further comprises a first GPS system 103, a first wireless system 104 and a mapping system 105. The first GPS system 103 is a device adapted to work with the global positioning network. The display unit 101 may include a processing member 166 and a battery pack 167. The battery pack 167 being housed inside of a battery compartment 168 located on a rear surface 169 of a display housing 170.

The purpose of the first GPS system 103 is to track the location of the display unit 101. The purpose of the first wireless system 104 is to wirelessly receive position information from the tracking unit 102. Depending on the application, the first wireless system 104 can us local area wireless configurations such as 802.11 or Bluetooth or broad area wireless communications such as sending text messages (SMS) over the cellular network. The mapping system 105 is a commercially available mapping system 105 that is capable of displaying on a map the last reported positions of the display unit 101 and the tracking unit 102.

The tracking unit 102 comprises a second GPS system 106, a second wireless system 107, a housing 108, a magnetic lock 109, a quick response bar code 110, a microcontroller 111, and a battery pack.

The second GPS system 106 is a device adapted to work with the global positioning network. The purpose of the second GPS system 106 is to track the location of the tracking unit 102. The purpose of the second wireless system 107 is to wirelessly transmit the position information from the second wireless system 107 from the tracking unit 102 to the display unit 101. Depending on the application, the first wireless system 104 can use local area wireless configurations such as 802.11 or Bluetooth or broad area wireless communications such as sending text messages (SMS) over the cellular network. The second wireless system 107 protocol is selected to match the protocol selected for the first wireless system 104. The microcontroller 111 is a programmable device that accepts digital and analog inputs, processes the digital and analog inputs according to previously stored instruction and provides the results of these instructions as digital or analog outputs. The microcontroller 111 is programmed to download the position information received by the second GPS system 106, prepare the position information for transmittal to the display unit 101 and initiate the second wireless system 107 to transmit the position information to the display unit 101.

The housing 108 is a container that holds the second GPS system 106, the second wireless system 107, the microcontroller 111, and the battery pack 112. The housing 108 has mounted on it a magnetic lock 109 and a quick response code 110. The magnetic lock 109 is a tamper resistant device that is used to connect the housing 108 to a child's 132 clothing. This technology is similar to the technology used to protect clothing from theft in retail outlets. The quick response bar code 110 is placed on the outside of the housing 108 as a label. The purpose of the quick response bar code 110 is to provide identification, emergency contact, and medical information for use by emergency personnel. The quick response bar code 110 can provide this information in one of two ways. In the first way, the identification, emergency contact, and medical information is encoded directly into the quick response bar code 110. In the second way, the quick response bar code 110 redirects the emergency personnel to a website that contains the identification, emergency contact, and medical information for the child 132

The battery pack 112 is used to power the second GPS system 106, the second wireless system 107 and the microcontroller 111. The battery pack 112 can use disposable batteries or it can be a rechargeable battery that is charged using a standard micro USB port. If the battery pack 112 uses disposable batteries, the housing 108 is modified to provide an access port to allow replacement of the batteries.

Once the position information is received by the display unit 101, the display unit 101 calculates the distance between the position of the display unit 101 and the position of the tracking unit 102. If the distance between the display unit 101 and the tracking unit 102 is greater than a predetermined allowed distance, an alarm is generated on the display unit 101 to let the parent or other responsible party 131 (hereinafter parent) know that the child 132 is beyond allowed range.

The display unit 101 is also provided with a software function that allows the parent 131 to call up the current (or last known) position of both the display unit 101 and the tracking unit 102 on a previously installed mapping system 105.

In a first optional enhancement, a second speaker 114 can be installed in the tracking unit 102. In this scenario, the display unit 101 sends a wireless signal to the tracking unit 102 which instructs the microcontroller 111 to send an audible signal to a second speaker 114 on the tracking unit 102.

In a second optional enhancement, a panic button 113 is installed on the tracking unit 102. In this scenario, when the child 132 pushes the panic button 113 the microcontroller 111 sends a wireless alarm signal to the display unit 101 which generates an alarm to the parent 131 indicating that the child 132 needs assistance.

To use the invention 100, the display unit 101 and the tracking unit 102 must first be synced. Once the display unit 101 and the tracking unit 102 are synced the system is ready for use. As long the battery pack 112 can provide power to the tracking unit 102, the tracking unit 102 will track its position and attempt to send a wireless signal to the display unit 101. Once the display unit's 101 application software is initiated, the display will continuously receive and track the location of the tracking unit 102 relative to the position of the display unit 101. The predetermined allowed distance is a parameter that is set within the display unit's 101 application software.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A locator system comprising:

a display unit and a tracking unit;

wherein the locator system is adapted for use with a child;

wherein the tracking unit is adapted to be attached to the child's clothing;

wherein the display unit is adapted to be carried by a parent;

wherein the tracking unit tracks the position of the tracking unit;

wherein the tracking unit transmits the position of the tracking unit to the display unit;

wherein the display unit tracks the distance between the display unit and the tracking unit;

wherein when the distance between the display unit and the tracking unit is greater than a predetermined allowable distance the display unit sounds an alarm;

wherein the display unit further comprises a first GPS system;

wherein the first GPS system tracks the location of the display unit;

wherein the display unit further comprises a first wireless system;

wherein the first wireless system receives position information from the tracking unit;

wherein the display unit further comprises a mapping system;

wherein the tracking unit further comprises a second GPS system;

wherein the second GPS system tracks the location of the tracking unit;

wherein the tracking unit further comprises a second wireless system;

wherein the second wireless system transmits the position of the tracking unit to the display unit;

wherein the tracking unit further comprises a microcontroller;

wherein the microcontroller is programmed to download the position information received by the second GPS system, prepare the position information for transmittal to the display unit and initiate the second wireless system to transmit the position information to the display unit;

wherein the tracking unit further comprises a housing and a battery pack;

wherein the housing contains the second GPS system, the second wireless system, the microcontroller, and the battery pack;

wherein a quick response bar code is placed on the outside of the housing;

wherein the quick response bar code provides information for use by emergency personnel;

wherein the information is encoded directly into the quick response bar code;

wherein the tracking unit further comprises a magnetic lock;

wherein the magnetic lock is a tamper resistant device that is configured to be used to connect the housing to a child's clothing;

wherein the quick response bar code is encoded to redirect emergency personnel to a website;

wherein the display unit is also provided with a software function that allows the parent to call up the or last known position of both the display unit and the tracking unit on the mapping system.

2. The locator system according to claim 1 wherein the display unit is a commercially available tablet or smart phone.

3. The locator system according to claim 1 wherein a second speaker is installed in the tracking unit;

wherein the display unit is programmed to send a signal to the tracking unit which instructs the microcontroller to send an audible signal to the second speaker.

4. The locator system according to claim 1 wherein a panic button is installed on the housing;

wherein when the panic button is pushed the microcontroller sends a wireless alarm signal to the display unit.

* * * * *